US009287104B2

(12) United States Patent
Akutsu

(10) Patent No.: US 9,287,104 B2
(45) Date of Patent: Mar. 15, 2016

(54) MATERIAL INSPECTION APPARATUS AND MATERIAL INSPECTION METHOD

(71) Applicant: KABUSHIKI KAISHA TOSHIBA, Minato-Ku, Tokyo (JP)

(72) Inventor: Haruko Akutsu, Yokosuka (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 14/095,754

(22) Filed: Dec. 3, 2013

(65) Prior Publication Data

US 2015/0048244 A1 Feb. 19, 2015

Related U.S. Application Data

(60) Provisional application No. 61/865,974, filed on Aug. 14, 2013.

(51) Int. Cl.
*H01J 49/16* (2006.01)
*H01J 49/00* (2006.01)

(52) U.S. Cl.
CPC ..... *H01J 49/164* (2013.01); *H01J 49/0027* (2013.01); *H01J 49/0004* (2013.01)

(58) Field of Classification Search
CPC ..... H01J 37/285; H01J 49/0036; H01J 49/26; H01J 2237/2855; H01J 2237/04; H01J 2237/05; H01J 49/0004; H01J 37/05; H01J 49/0027; H01J 49/164; G01N 23/22
See application file for complete search history.

(56) References Cited

U.S. PATENT DOCUMENTS 8,575,544 B1 * 11/2013 Kelly ..... H01J 37/244 250/281
8,604,421 B2 * 12/2013 Skilling ..... G06K 9/0057 250/282
2007/0054402 A1 * 3/2007 Jasper ..... G07F 7/086 436/56
2007/0158542 A1 * 7/2007 Bauer ..... H01J 49/0036 250/282
2008/0308728 A1 * 12/2008 Kelly ..... G01N 23/22 250/307
2009/0050797 A1 * 2/2009 Gribb ..... H01J 49/168 250/281
2010/0116985 A1 * 5/2010 Bunton ..... H01J 37/3045 250/307
2010/0288926 A1 * 11/2010 Wiener ..... H01J 37/265 250/309
2010/0294928 A1 * 11/2010 Bunton ..... H01J 37/285 250/307
2011/0260054 A1 * 10/2011 Bunton ..... B82Y 15/00 250/307
2012/0080596 A1 * 4/2012 Vandervorst ..... H01J 37/226 250/307
2013/0200258 A1 * 8/2013 Skilling ..... G06K 9/0057 250/282
2014/0158879 A1 * 6/2014 Skilling ..... G06K 9/0057 250/282

FOREIGN PATENT DOCUMENTS

JP 2001-216933 A 8/2001
JP 2007-040966 A 2/2007

* cited by examiner

*Primary Examiner* — Wyatt Stoffa
(74) *Attorney, Agent, or Firm* — Holtz, Holtz & Volek PC

(57) ABSTRACT

A material inspection apparatus according to the present embodiment includes a sample mount capable of mounting a sample. A detector detects an atom desorbed from the sample. A voltage generator applies a voltage to the sample. A laser generator irradiates a laser beam onto the sample. An arithmetic part processes a detection result of the detector. A storage part stores a detection prediction range of a certain element and an isotope of the certain element. A display displays the detection prediction range and an actual detection result of the detector in a comparable manner.

4 Claims, 9 Drawing Sheets

MATERIAL INSPECTION APPARATUS AND MATERIAL INSPECTION METHOD

CROSS REFERENCE TO RELATED APPLICATIONS

This application is based upon and claims the benefit of priority from the prior U.S. Provisional Patent Application No. 61/865,974 filed on Aug. 14, 2013, the entire contents of which are incorporated herein by reference.

FIELD

The embodiments of the present invention relate to a material inspection apparatus and a material inspection method.

BACKGROUND

An atom probe device is an apparatus that ionizes and evaporates atoms on a sample surface by applying a voltage and/or a laser beam to the sample, and that performs a material analysis on the sample at an atomic level by detecting ions using a mass detector. The atom probe device identifies a mass-to-charge ratio of each ion by measuring a flight time of the ion from the sample to the mass detector. The atom probe device thereby discriminates the atoms constituting the sample from one another. Furthermore, the atom probe device identifies relative positions of the respective atoms present on the sample by measuring a position at which each ion hits the mass detector.

However, molecular ions or multi-charged ions are generated at the time of ionization of the atoms present on the sample. Therefore, different types of a plurality of ions sometimes show similar mass-to-charge ratios. In such a case, a user discriminates the ions by comparing an isotope ratio in a detection result with a natural isotope ratio of the element and determining whether the former and the latter match each other.

However, when an element contained in the sample is small in amount, the isotope ratio in the detection result is largely dispersed. As a result, the isotope ratio sometimes largely deviates from the natural isotope ratio. In this case, some users doubt whether the element is present and possibly and erroneously determine that the element is not present in the sample. That is, there is a probability that the element actually contained in the sample is erroneously ignored.

DETAILED DESCRIPTION

Embodiments will now be explained with reference to the accompanying drawings. The present invention is not limited to the embodiments.

A material inspection apparatus according to the present embodiment includes a sample mount capable of mounting a sample. A detector detects an atom desorbed from the sample. A voltage generator applies a voltage to the sample. A laser generator irradiates a laser beam onto the sample. An arithmetic part processes a detection result of the detector. A storage part stores a detection prediction range of a certain element and an isotope of the certain element. A display displays the detection prediction range and an actual detection result of the detector in a comparable manner.

First Embodiment

Figure 1:
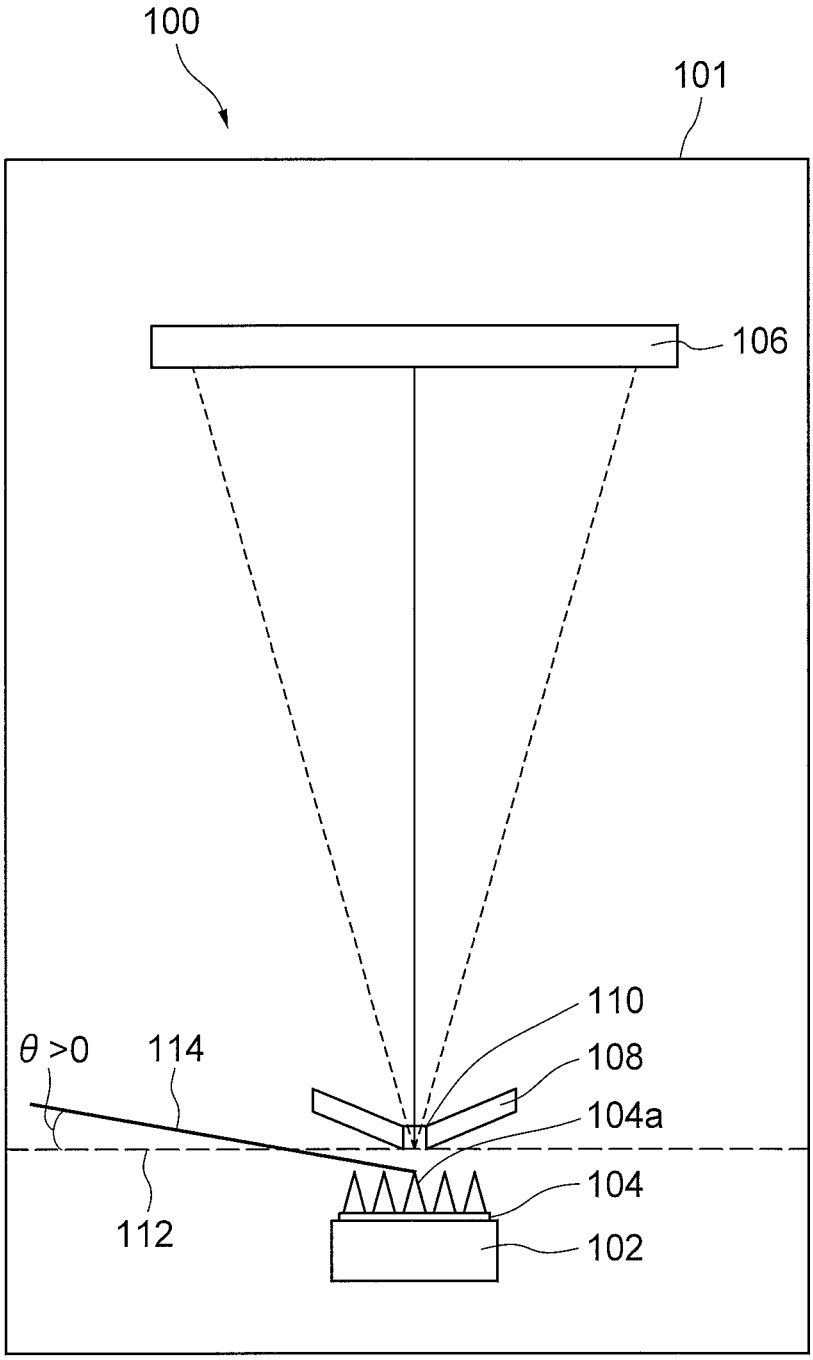
FIG. 1 shows an example of a configuration of a laser atom probe serving as a material inspection apparatus according to an embodiment.

FIG. 1 shows an example of a configuration of a laser atom probe serving as a material inspection apparatus according to an embodiment. An atom probe 100 includes a vacuum chamber 101, a sample mount 102, a mass detector 106, and an electrode 108.

The vacuum chamber 101 accommodates the sample mount 102, the mass detector 106, the electrode 108, and the like. An interior of the vacuum chamber 101 is vacuumed.

The sample mount 102 mounts thereon a sample 104, and applies a voltage to the sample 104. The voltage applied to the sample 104 can be set to a predetermined constant voltage or a pulsed boost voltage applied at each timing of desorption of ionized atoms from the sample 104. The sample 104 is produced on a semiconductor substrate using, for example, FIB (focused ion beam), etching or dicing, and the sample 104 has a tip end 104*a* processed into a needle shape. For example, the sample 104 is produced in order to analyze and identify materials contained in a structure formed on the semiconductor substrate.

The mass detector 106 receives ions field-evaporated from the tip end 104*a* of the sample 104 so as to identify a mass-to-charge ratio of each of the ions or a relative position (a three dimensional position) of each of the atoms in the sample 104.

The electrode 108 is located between the sample mount 102 and the mass detector 106 and has an aperture 110 provided in a central portion thereof. The electrode 108 focuses an electric field on the neighborhoods of the tip end 104*a* of the sample 104 and thereby reduces energy necessary for a laser beam 114. The voltage of the electrode 108 can be set to a reference voltage (a ground potential or an arbitrary fixed potential, for example) or a pulsed voltage applied at each timing of the desorption of ionized atoms from the sample 104. Reference numeral 112 denotes an end surface of the tip end of the sample 104.

The sample mount 102 can move the tip end 104*a* of the sample 104 for positioning. The sample mount 102 moves the sample 104 so that the tip end 104*a* of the sample 104 is located in a central portion within the aperture 110 when viewed from a central portion of the mass detector 106.

The laser beam 114 is irradiated onto the tip end 104*a* from a direction inclined at a certain angle θ with respect to the end surface 112. According to need, the laser beam 114 can be oriented using a mirror, a collimator, a lens and/or another optical system, and can be focused on the tip end 104*a*. A pulsed laser beam applied at each timing of the desorption of the ionized atoms from the sample 104 can be used as the laser beam 114. The laser beam 114 can be emitted from an optical system (not shown) arranged inside the vacuum chamber 101 or introduced from an optical system arranged outside the vacuum chamber 101.

Figure 2:
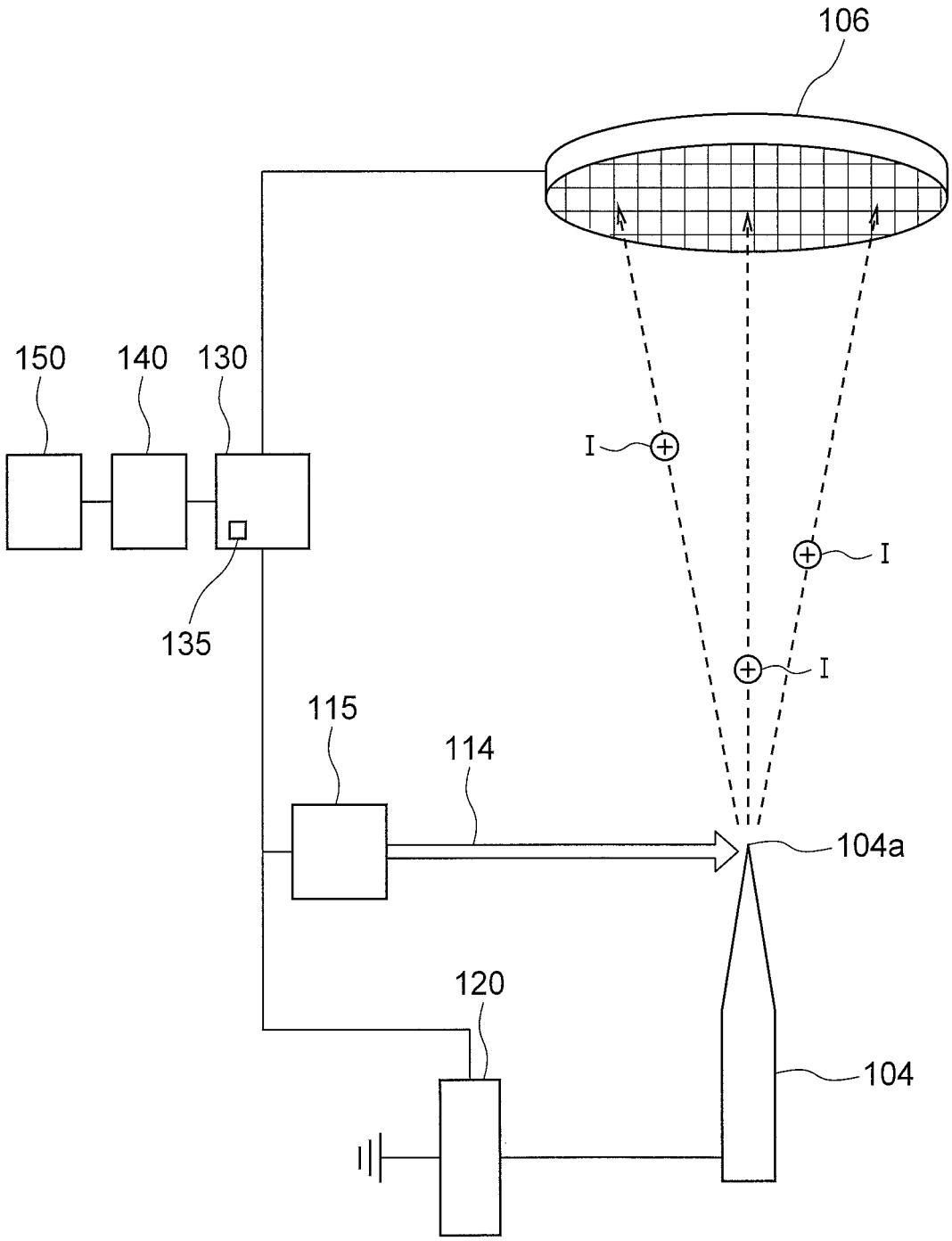
FIG. 2 is an explanatory diagram showing an example of a configuration of the atom probe 100 and an operation performed by the atom probe 100 according to the first embodiment.

FIG. 2 is an explanatory diagram showing an example of a configuration of the atom probe 100 and an operation performed by the atom probe 100 according to the first embodiment. The atom probe 100 further includes an optical system 115, a voltage generator 120, an arithmetic control unit 130, a memory 140, and a display 150.

In the first embodiment, the voltage generator 120 continuously applies a high voltage to the sample 104. The optical system 115 includes a laser generator and irradiates the pulsed laser beam 114 onto the tip end 104*a* of the sample 104 at a certain timing. Atoms on a surface of the tip end 104*a* are thereby ionized and field-evaporated. At this time, the atoms are desorbed in order from those on the surface of the tip end 104*a*. Ions I desorbed from the tip end 104*a* fly to the mass detector 106 by a high electric field generated by a high voltage applied by the voltage generator 120 and a reference voltage of the electrode 108 (see FIG. 1).

The arithmetic control unit 130 is constituted by using, for example, a CPU (Central Processing Unit). The arithmetic control unit 130 measures a flight time of each individual ion I from the time at which the laser beam 114 is irradiated until the mass detector 106 detects the ion I. The arithmetic control unit 130 includes a timer 135 so as to measure the flight time of the ion I. Furthermore, the mass detector 106 detects at which point on a plane of the mass detector 106 the ion I is detected.

The memory 140 stores therein programs for actuating the atom probe 100 and data such as the flight time of each ion I, a position on the mass detector 106 detecting the ion I, and a spectrum prediction range. The spectrum prediction range is described later.

The display 150 displays the detection result of the sample, the spectrum prediction range, and the like. The display 150 can be a touch panel display.

The flight time of the ion I is used to identify the mass-to-charge ratio of the ion I. The arithmetic control unit 130 can thereby identify the mass-to-charge ratio of the ion I. The arithmetic control unit 130 can also identify a type (element) of the ion I from the mass-to-charge ratio.

The position on the mass detector 106 detecting the ion I is used to identify a relative position of the ion I on the sample 104. The arithmetic control unit 130 can thereby identify a relative position (a planar position) of the ion I on the sample 104.

Furthermore, the atoms are desorbed in order from those present on the surface of the tip end 104*a* for every laser pulse and/or every voltage pulse. Therefore, by identifying the type (the element) of the ion I for every laser pulse and/or every voltage pulse, the arithmetic control unit 130 can identify a relative depth of the ion I in the sample 104.

Because the planar position and the depth of the ion I on and in the sample 104 are identified, a three dimensional position of the ion I on the sample 104 is confirmed. The atom probe 100 can thereby three dimensionally detect what material (element) is present at what position on the tip end 104*a* of the sample 104.

As described above, molecular ions or multi-charged ions are generated at the time of ionization of the atoms present on the sample 104. Therefore, different types of a plurality of ions sometimes show similar mass-to-charge ratios. For example, a divalent ion of a silicon isotope (mass number: 28) is substantially equal in mass-to-charge ratio to a univalent ion of a nitrogen isotope (mass number: 14). It is difficult to discriminate such ions substantially equal in the mass-to-charge ratio from each other. In such a case, a user discriminates silicon from nitrogen by comparing an isotope ratio in the detected silicon with a natural isotope ratio of silicon.

However, when an element contained in the sample 104 is small in amount, the isotope ratio in the detection result is largely dispersed. Accordingly, the isotope ratio in the detection result sometimes largely deviates from the natural isotope ratio. For example, when the number of atoms of an element of interest contained in the sample 104 is 10000, the dispersion of the number of atoms (on the assumption of a standard deviation=1 σ) is 100. This means that the dispersion of the number of atoms of the element of interest is 1% of the total number of atoms. When the number of atoms of the element of interest contained in the sample 104 is larger than 10000, the dispersion of the number of atoms of the element of interest (on the assumption of the standard deviation=1 σ) is smaller than 1%. On the other hand, when the number of atoms of the element of interest contained in the sample 104 is smaller than 10000, the dispersion of the number of atoms of the element of interest (on the assumption of the standard deviation=1 σ) exceeds 1%. For example, when the number of atoms of the element of interest is 400, the dispersion of the number of atoms of the element of interest is 20 (5%). When the number of atoms of the element of interest is 100, the dispersion of the number of atoms of the element of interest increases to 10 (10%). Furthermore, when the element is constituted by a plurality of isotopes, the dispersion of the number of atoms of the element further increases. Therefore, the order of abundance (isotope ratio) of the isotopes in the detection result does not possibly match that of abundance (natural isotope ratio) of the isotopes in nature (the order changes). In such a case, it is difficult for a user to determine whether the element of interest is present even by comparing the isotope ratio in the detection result with the natural isotope ratio.

When the isotope ratio in the detection result largely deviates from the natural isotope ratio as described above, the user doubts whether the element is present and possibly and erroneously determines that the element is not present in the sample. Therefore, it is difficult to discriminate whether the isotope ratio in the detection result matches the natural isotope ratio by simply comparing the former with the latter.

Figure 3:
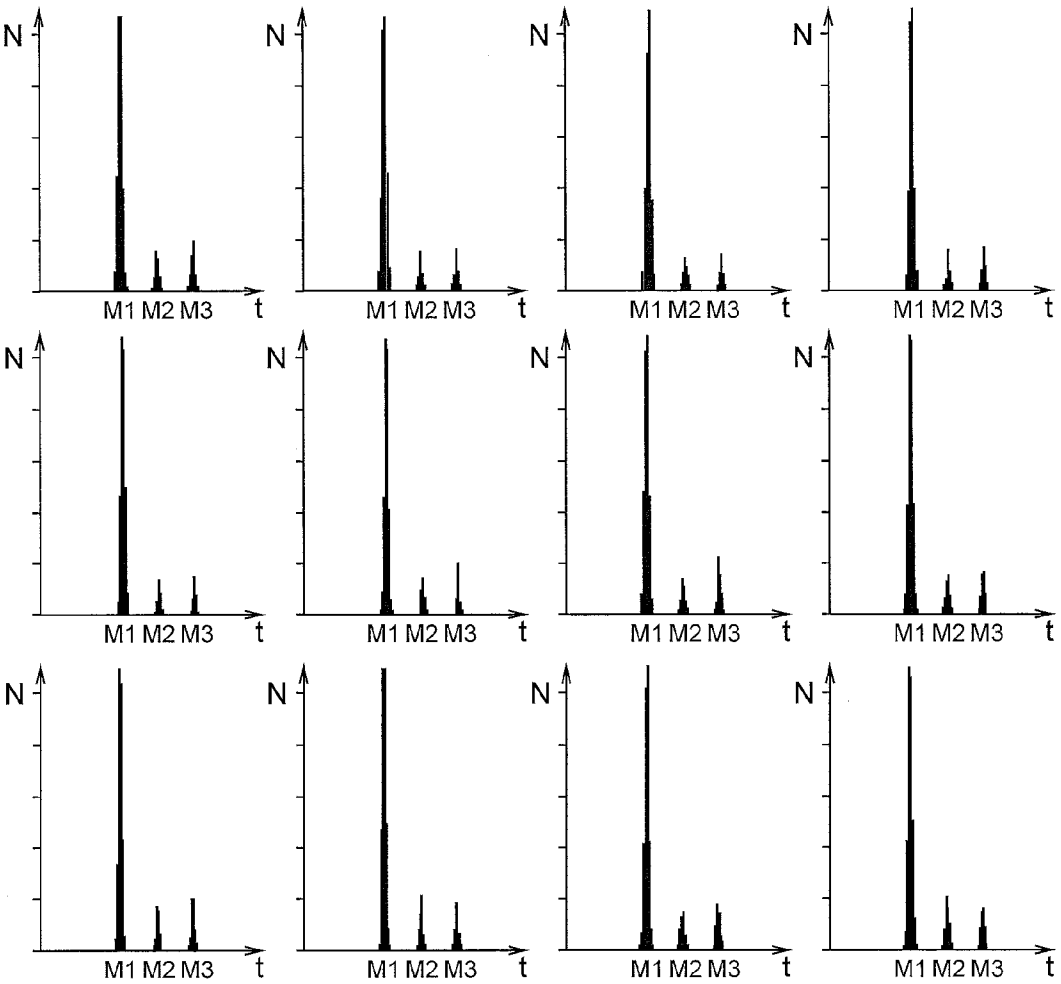
FIG. 3 shows graphs showing simulation results of spectrums in a case where the number of atoms of an element of interest M is 1000.

For example, FIG. 3 shows graphs showing simulation results of spectrums in a case where the number of atoms of an element of interest M is 1000. FIG. 3 shows 12 graphs. In FIG. 3, a vertical axis indicates the number (frequency) N of detected atoms and a horizontal axis indicates a flight time (or mass) t. Reference characters M1 to M3 denote isotopes of the element of interest M, respectively. As can be understood with reference to the graphs of FIG. 3, when the number of atoms is 1000, an order of abundance is either M1, M3, and M2 or M1, M2, and M3, and the abundance of the M2 is closer to that of the M3.

Figure 4:
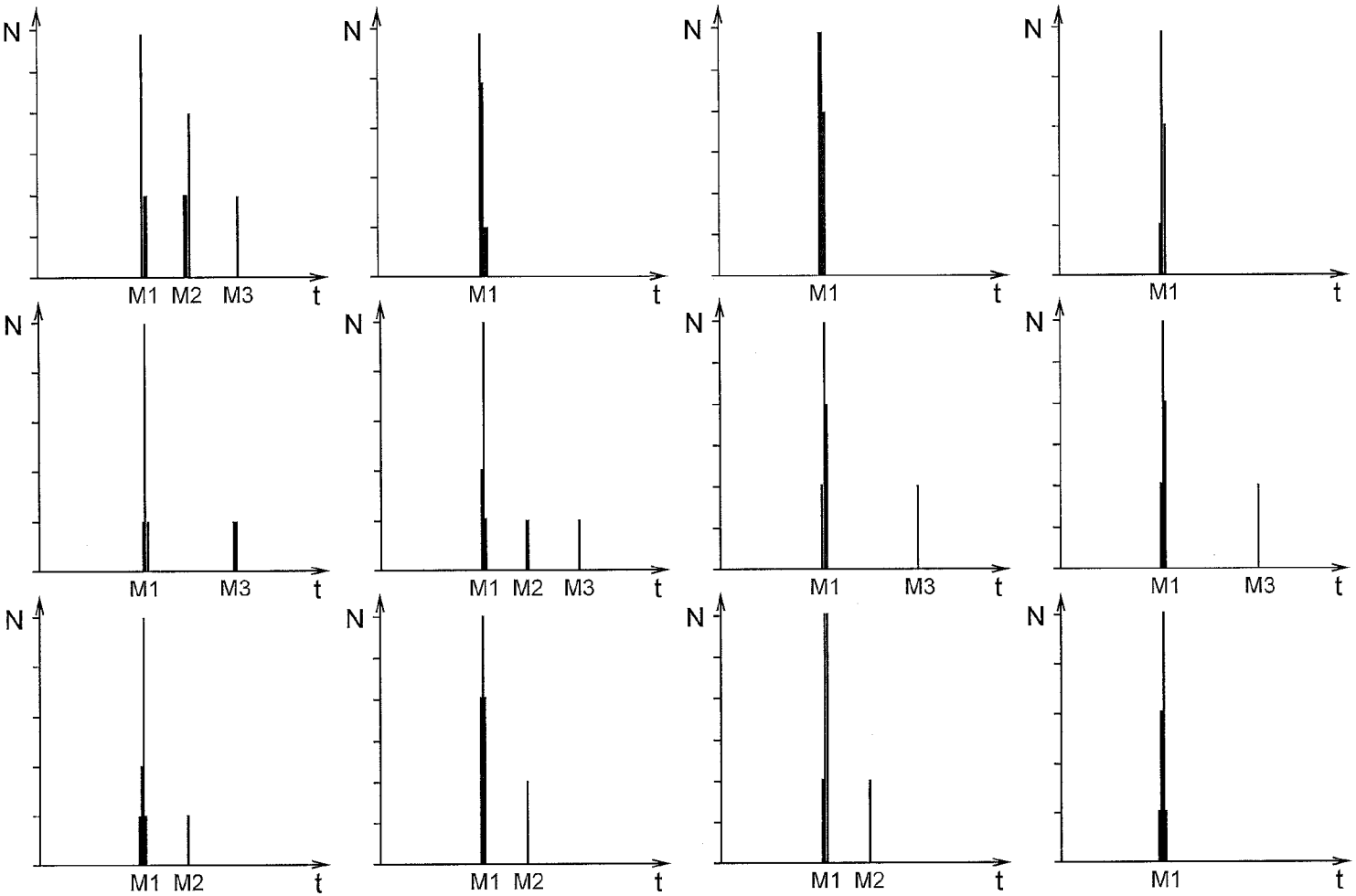
FIG. 4 shows graphs showing simulation results of spectrums of the element of interest M in a case where the number of atoms of the element of interest M is 10.

On the other hand, FIG. 4 shows graphs showing simulation results of spectrums of the element of interest M in a case where the number of atoms of the element of interest M is 10. Similarly to FIG. 3, FIG. 4 shows 12 graphs. As can be understood with reference to the graphs of FIG. 4, when the number of atoms is 10, the detection of the M2 and the M3 is dispersed although the M1 is detected.

It is assumed that the natural isotope ratio M1:M2:M3 of the element M is substantially 8:1:1 and that one of the simulation results shown in FIG. 3 is actually detected by the atom probe 100. In this case, the natural isotope ratio is similar to the actually detected isotope ratio. Therefore, it is possible to easily determine that the element M is present.

On the other hand, when one of the simulation results shown in FIG. 4 is actually detected by the atom probe 100, it is not possible to easily determine whether the natural isotope ratio is similar to the actually detected isotope ratio. Although the element M is actually present in the sample 104, a user possibly and erroneously determines that the element M is not present in the sample.

That is, in a case where the element M contained in the sample is large in amount, it is possible to easily determine whether the element M is present because the spectrums detected by the atom probe 100 are closer to the natural isotope ratio. However, in a case where the element M contained in the sample 104 is small in amount, there is a high probability that the spectrums detected by the atom probe 100 greatly differ from the natural isotope ratio. Accordingly, it is not possible to easily determine whether the element M is present.

Considering the above, in the first embodiment, a spectrum range in a case where the element M is present in the sample is predicted based on a plurality of simulation results as shown in FIG. 3 or 4. By comparing the actual measured spectrum with this spectrum prediction range, probability of the presence of the element M in the sample 104 is determined.

(Generation of Spectrum Prediction Range)

Figure 6B:
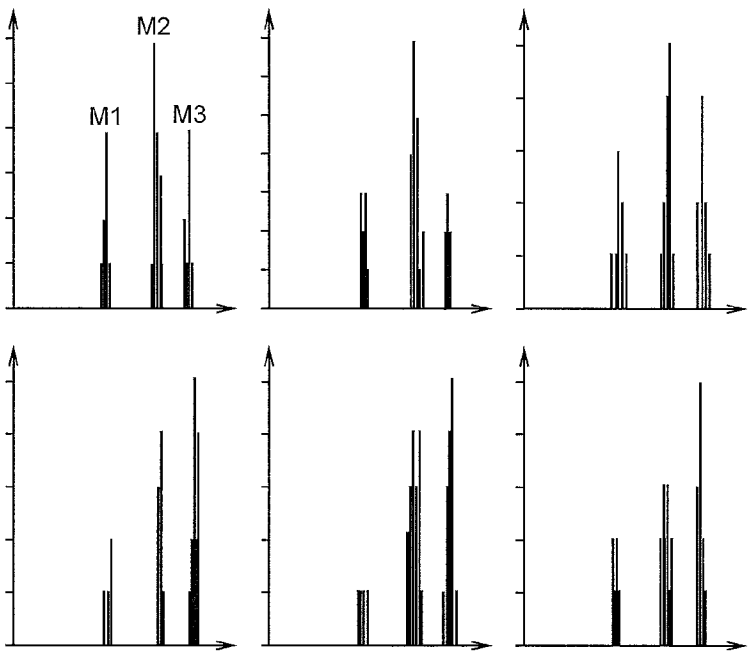
Figure 6A:
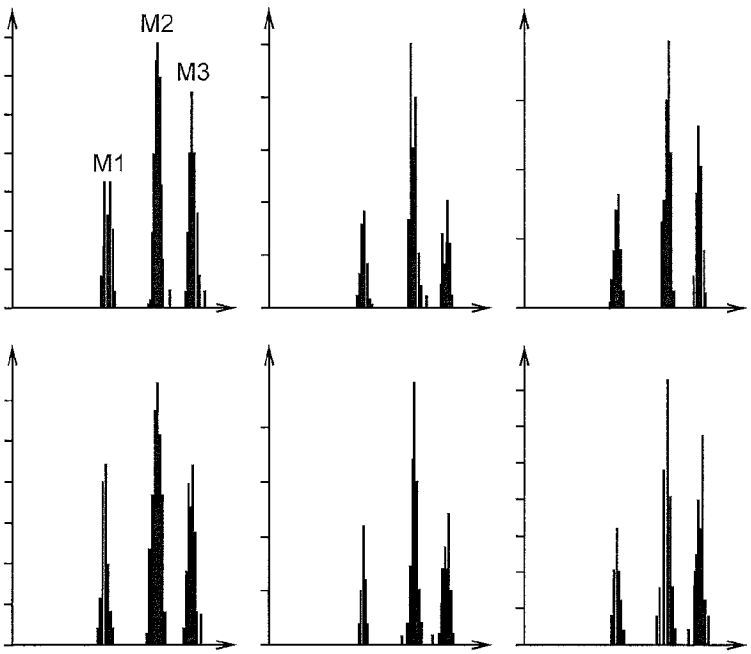
Figure 7B:
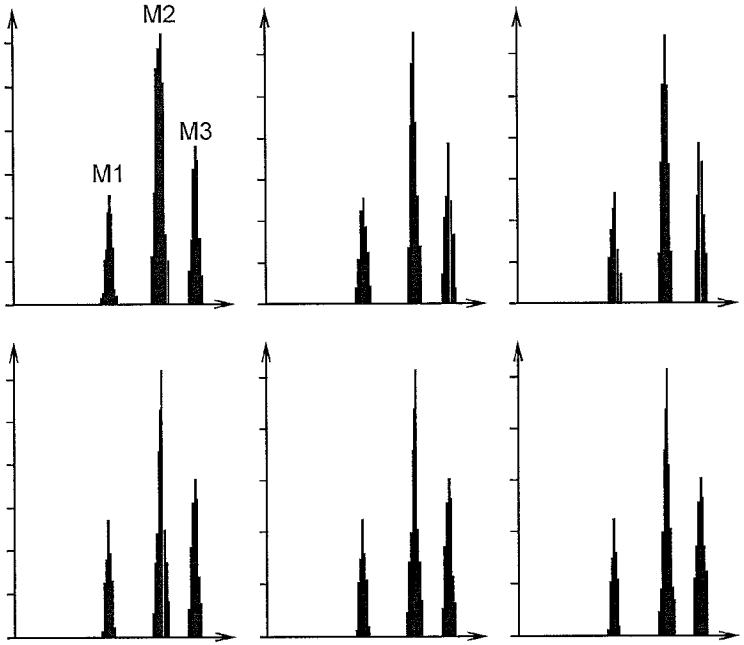
Figure 7A:
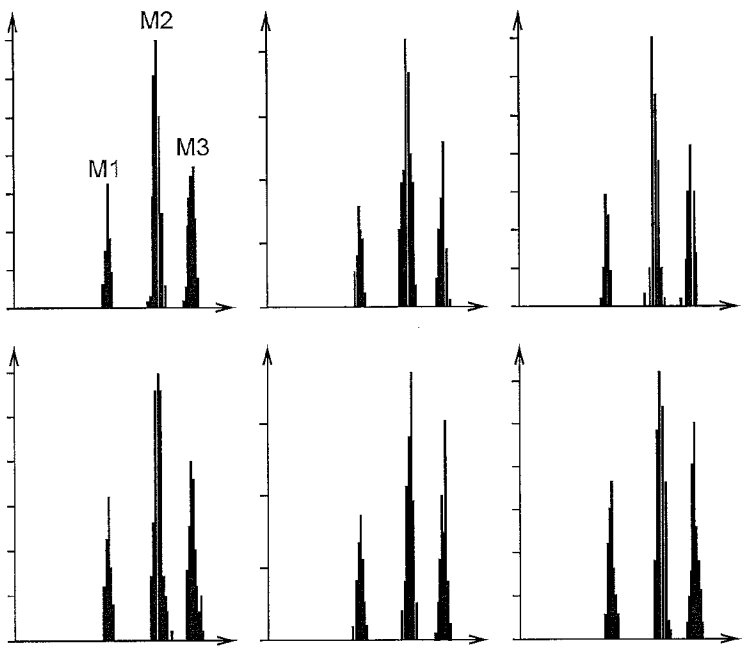
Figure 8:
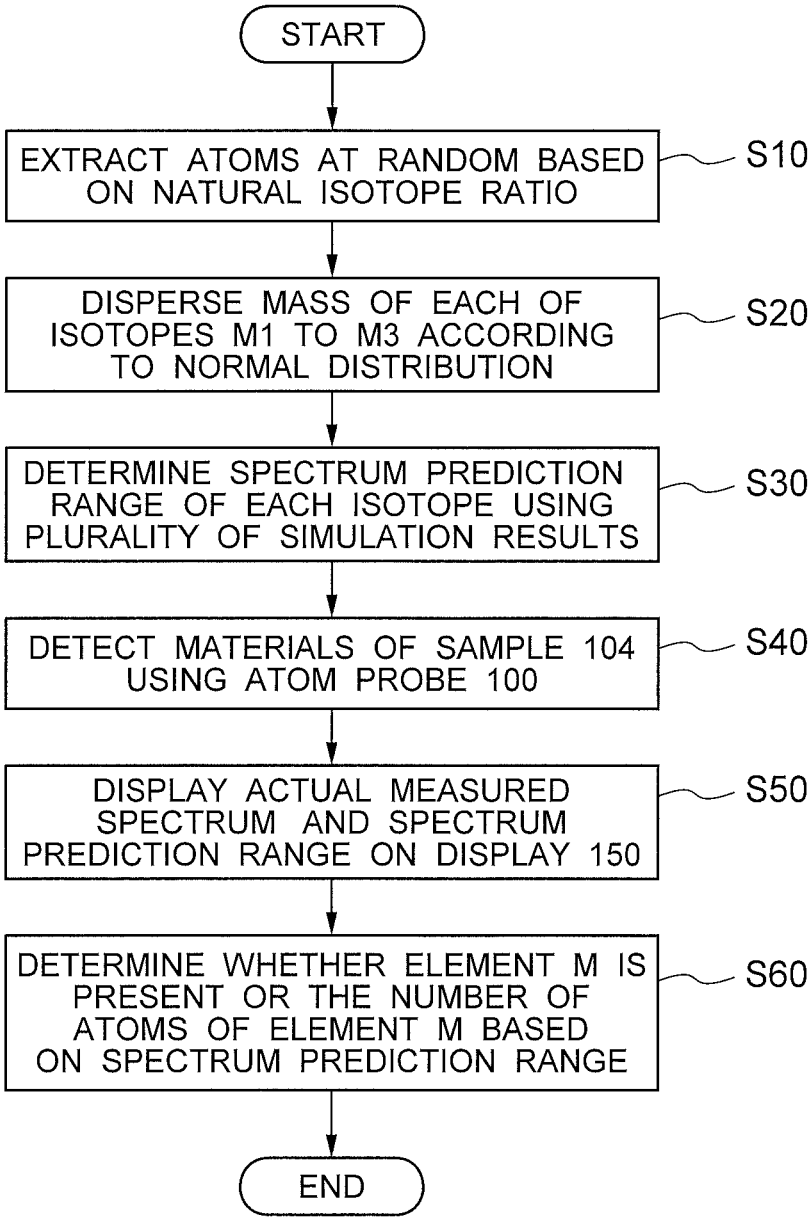
FIG. 8 is a flowchart showing a method of generating the spectrum prediction range and an element detection method.

The spectrum prediction range is generated using simulations. FIGS. 5A to 7B are graphs showing simulation results of spectrums of the isotopes M1 to M3 of the element M. FIG. 8 is a flowchart showing a method of generating the spectrum prediction range and an element detection method.

Figure 5B:
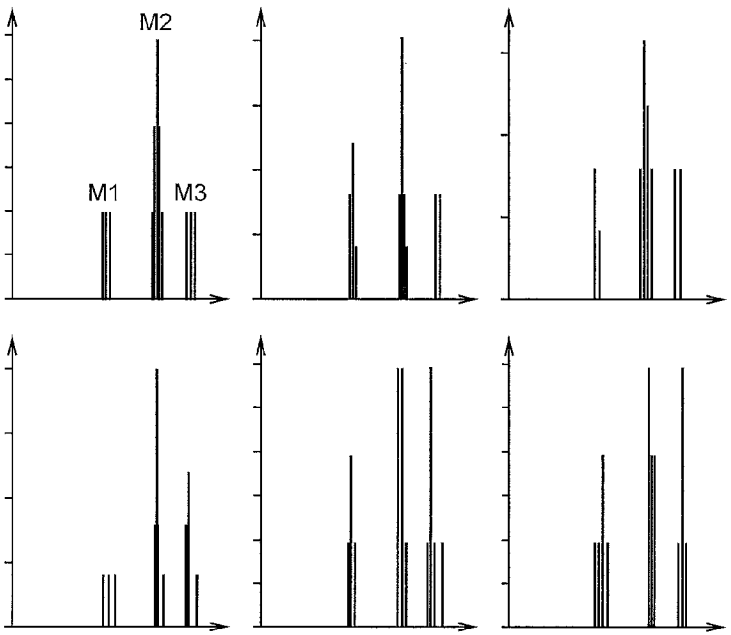
FIGS. 5A to 7B are graphs showing simulation results of spectrums of the isotopes M1 to M3 of the element M.
Figure 5A:
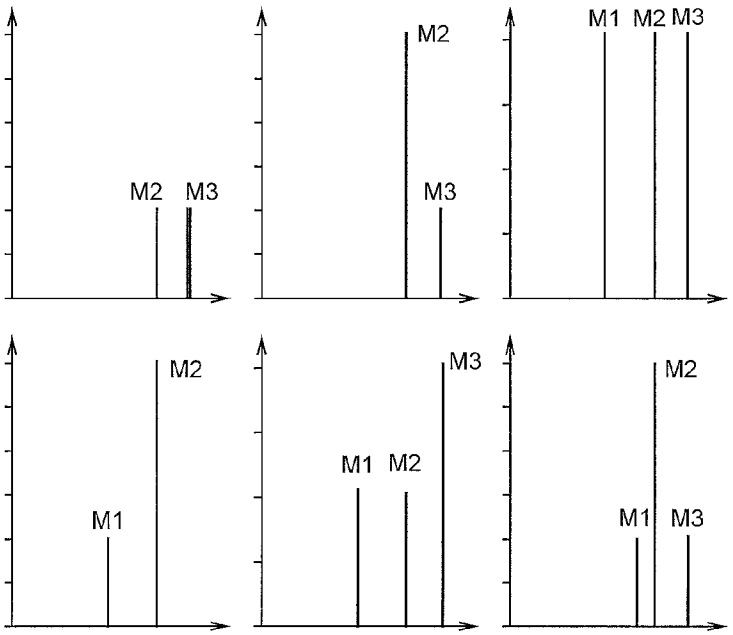

FIG. 5A shows a spectrum simulation result when the number of detected atoms is 10. FIG. 5B shows a spectrum simulation result when the number of detected atoms is 50. FIG. 6A shows a spectrum simulation result when the number of detected atoms is 100. FIG. 6B shows a spectrum simulation result when the number of detected atoms is 500. FIG. 7A shows a spectrum simulation result when the number of detected atoms is 1000. FIG. 7B shows a spectrum simulation result when the number of detected atoms is 5000. Each of FIGS. 5A to 7B shows six simulation results. In all of the graphs of FIGS. 5A to 7B, the vertical axis indicates the number (frequency) and the horizontal axis indicates the mass (isotope type). The number of simulations for determining the spectrum prediction range is not specifically limited. More than six or less than six simulations can be performed for determining the spectrum prediction range. However, a frequency dispersion range (the spectrum prediction range) changes depending on the number of simulations. Therefore, the number of simulations is set to an appropriate number from several to several tens.

With reference to FIGS. 5A to 7B, when the number of detected atoms is small, detection results of each isotope are largely dispersed. However, when the number of detected atoms is large, the detection results of each isotope are stable and not largely dispersed.

For example, as shown in FIG. 5A, when the number of detected atoms is 10, the simulation results are largely dispersed. More specifically, the numbers of the detected isotopes M1 to M3 greatly differ among the simulations. Some isotopes are not detected in some simulations. The isotope ratio in the simulation results of FIG. 5A is also dispersed and sometimes greatly differs from the natural isotope ratio. The isotope ratio in these simulations is further dispersed when the number of detected atoms is equal to or smaller than 10.

On the other hand, as shown in FIG. 7B, when the number of detected atoms is 5000, the dispersion of the simulation results is small and the isotope ratio in the simulation results substantially matches the natural isotope ratio. More specifically, it is the M2 that has the largest number of detected atoms and the M3 and the M1 follow the M2 in this order. The isotope ratio in these simulations further converges into the natural isotope ratio and becomes more stable when the number of detected atoms is larger than 5000.

With reference to FIGS. 5A to 7B, it is understood that the isotope ratio becomes more stable and closer to the natural isotope ratio as the number of detected atoms is larger.

In the first embodiment, the spectrum prediction range is determined using these simulation results. For example, the simulation in the case where the number of detected atoms is 10 as shown in FIG. 5A is repeated 20 times. In each simulation, ten atoms are extracted at random based on the natural isotope ratio (S10). More specifically, percentages from 0 to 1 are allocated to the M1 to the M3, respectively based on the natural isotope ratio. For example, when the natural isotope ratio M1:M2:M3 is 1:2:1.5, 0 to 0.222, 0.222 to 0.667, and 0.667 to 1 are allocated to the M1, the M2, and the M3, respectively. Ten random numbers from 0 to 1 are generated and it is assumed that an isotope to which each of the random numbers belongs is detected, respectively. For example, when a certain random number is 0.6, it is assumed that the M2 is detected. When the ten random numbers are generated, ten isotopes (M1, M2, or M3) are extracted.

Next, the mass of each of the isotopes M1 to M3 is dispersed according to a distribution function (nominal distribution, for example) (S20). An actual spectrum of each isotope does not completely match the position of the mass number of the isotope but is dispersed around the mass number to some extent. The dispersion of the mass number can be calculated either in theory or experimentally. That is, in the first embodiment, as the spectrum of each isotope, either the nominal distribution or the dispersion and distribution of data measured by the actual atom probe 100 as well as the central limit theorem can be used. For example, a mass spectrum of each of the isotopes elements M1 to M3 is measured using the atom probe 100 experimentally. At this time, the mass spectrum of each of the elements M1 to M3 has a nominal distribution. It suffices to disperse the mass numbers of the elements M1 to M3 using these nominal distributions, respectively.

The dispersion of the mass number is the dispersion of a detection time. The detection time is a sum (T1+T2+T3) of a time T1 required since output of a trigger signal for outputting a laser beam or applying a voltage until ionization of each atom, a time T2 required until the atom flies from the sample 104 to the mass detector 106, and a time T3 required until the atom is detected by interaction of the atom with the mass detector 106. The dispersion of the time T1 depends on the dispersion of the trigger signal (dispersion of a rising time of a signal circuit and a laser pulse or a voltage pulse) and the dispersion of the time at which the atom is ionized by the laser beam or the voltage. The dispersion of the time T2 depends on the dispersion caused by the interaction with residual gas in the vacuum chamber 101 and electric field disturbance during the flight of the atom. The dispersion of the time T3 depends on the dispersion of the time required since the atom reaches the mass detector 106 until the detection of the atom changes to a signal. Because a surface of the mass detector 106 has portions different in sensitivity, the time required until the detection of the atom changes to the signal is sometimes dispersed depending on where on the mass detector 106 the atom reaches. In this way, the detection time is dispersed. Therefore, the dispersion of the detection time and the number of detected atoms of one type are determined by an ionization probability of the atom, transmittance of the atom, the dispersion of measuring instruments, the interaction of the atom with another type of atom in the vacuum chamber 101, and the detection time of the mass detector 106. It is also possible to obtain distributions of the mass numbers of the respective elements M1 to M3 by calculation using these relations.

Next, using a plurality of simulation results, the spectrum prediction range of each of the isotopes M1 to M3 is determined (S30). For example, a maximum value and a minimum value among the 20 simulation results are obtained for each of the isotopes M1 to M3, and a range between the maximum value and the minimum value can be determined as the spectrum prediction range. Needless to mention, the spectrum prediction range can be determined by processing the range between the maximum value and the minimum value. For example, a range obtained by narrowing the range between the maximum value and the minimum value by a certain value or a certain rate can be determined as the spectrum prediction range. With this configuration, the spectrum prediction range in the case where the number of detected atoms is 10 is generated for each of the isotopes M1 to M3.

A plurality of spectrum prediction ranges can be prepared according to the numbers of detected atoms. For example, spectrum prediction ranges in cases where the numbers of detected atoms are 10, 50, 100, 500, 1000, and 5000 are prepared, respectively. This set of spectrum prediction ranges is stored in the memory 140 included in the atom probe 100 in advance.

Furthermore, the spectrum prediction ranges can be prepared to correspond to a plurality of types of elements, respectively. There exist many elements having isotopes. Therefore, a set of spectrum prediction ranges according to the numbers of atoms is prepared for each of, for example, magnesium, titanium, hafnium, tungsten, and molybdenum. A user or the atom probe 100 can thereby determine whether each of various types of elements contained in the sample 104 is present or the number of atoms of each element.

A PC (Personal Computer) other than the atom probe 100 can generate the spectrum prediction ranges or the arithmetic control unit 130 included in the atom probe 100 can generate the spectrum prediction ranges.

Next, as described with reference to FIG. 2, the atom probe 100 performs material detection using the sample 104 (S40). The atom probe 100 thereby obtains actual spectrums (hereinafter, "actual measured spectrums") of the sample 104.

(Element Detection Determination)

The atom probe 100 displays the actual measured spectrums and the spectrum prediction ranges on the display 150 (S50). At this time, the atom probe 100 displays the actual measured spectrums and the spectrum prediction ranges in a comparable manner. For example, the atom probe 100 can display the actual measured spectrums and the spectrum prediction ranges by laying them side-by-side or by superposing them. Moreover, the atom probe 100 can display the natural isotope ratio as well as the actual measured spectrums and the spectrum prediction ranges.

Figure 9B:
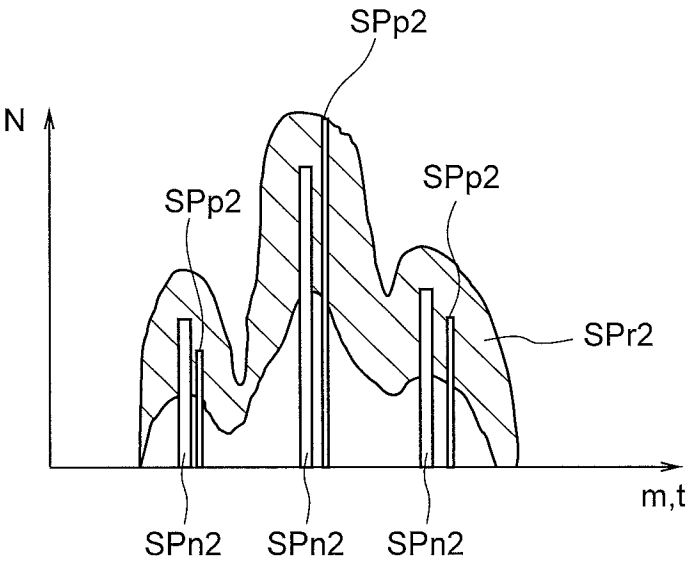
FIG. 9B is a graph showing an example of superposing a natural isotope ratio SPn2, actual measured spectrums SPp2, and spectrum prediction ranges SPr2.
Figure 9A:
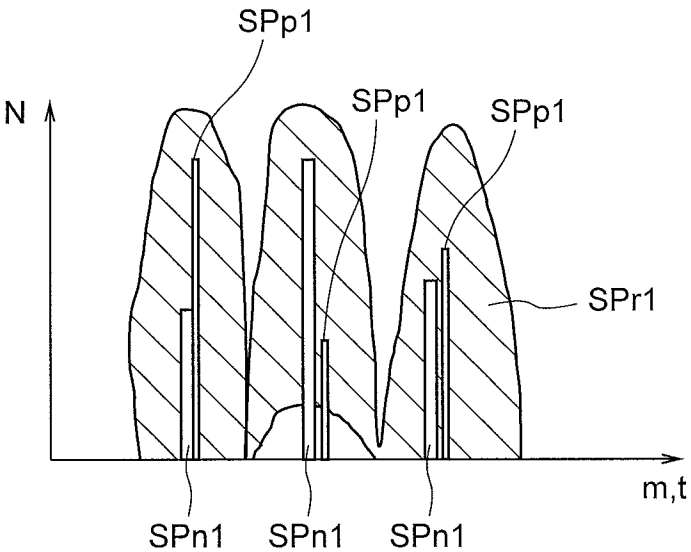
FIG. 9A is a graph showing an example of superposing a natural isotope ratio SPn1, actual measured spectrums SPp1, and spectrum prediction ranges SPr1.

For example, FIG. 9A is a graph showing an example of superposing a natural isotope ratio SPn1, actual measured spectrums SPp1, and spectrum prediction ranges SPr1. FIG. 9B is a graph showing an example of superposing a natural isotope ratio SPn2, actual measured spectrums SPp2, and spectrum prediction ranges SPr2. For the convenience of description, in the following explanations, the actual measured spectrums SPp1 and SPp2, and the spectrum prediction ranges SPr1 and SPr2 are referred to while being assumed as a singular. FIG. 9A uses the spectrum prediction range SPr1 in a case where the number of atoms is 50. FIG. 9B uses the spectrum prediction range SPr2 in a case where the number of atoms is 1000. In FIGS. 9A and 9B, the vertical axis indicates the number (frequency) N and the horizontal axis indicates the flight time t or the mass m (isotope type). While FIGS. 9A and 9B show cases where the number of isotopes is three, the number of isotopes is not limited to a specific number. That is, the type of the element M is not specifically limited.

As shown in FIG. 9A, when the number of atoms is 50, the spectrum prediction range SPr1 is wide because the simulation-based spectrums are largely dispersed. As shown in FIG. 9B, when the number of atoms is 1000, the simulation-based spectrums are dispersed to some extent. However, the dispersion is smaller than that of the spectrums in a case where the number of atoms is 50. Accordingly, the spectrum prediction range SPr2 in the case where the number of atoms is 1000 is narrower than the spectrum prediction range SPr1 in the case where the number of atoms is 50.

In the first embodiment, a user or the atom probe 100 determines whether the element M is present based on the spectrum prediction ranges SPr1 and SPr2 (S60). For example, when the number of atoms contained in the sample 104 is actually small (for example, equal to or smaller than 50), the actual measured spectrum SPp1 is dispersed. Accordingly, the actual measured spectrum SPp1 possibly deviates from the spectrum prediction range SPr2 shown in FIG. 9B. That is, when the spectrum prediction range SPr2 is used, the user or the atom probe 100 possibly and erroneously determines that the element M actually contained in the sample 104 is not present. However, when the spectrum prediction range SPr1 is used, the actual measured spectrum SPp1 falls within the spectrum prediction range SPr1. Accordingly, the user or the atom probe 100 can determine that the element M is present in the sample 104.

Needless to mention, the spectrum prediction ranges SPr1 and SPr2 are only predictions and cannot necessarily ensure identifying the presence of the element M. Nevertheless, the spectrum prediction ranges SPr1 and SPr2 are spectrum ranges generated based on the natural isotope ratios SPn1 and SPn2, respectively. Accordingly, in the first embodiment, it is possible to determine that the element M is present with a higher probability than that of simple comparison of the actual measured spectrums SPp1 and SPp2 with the natural isotope ratios SPn1 and SPn2, respectively.

In the above example, the actual measured spectrum SPp1 deviates from the spectrum prediction range SPr2 but falls within the spectrum prediction range SPr1. Therefore, it is possible to estimate that the number of atoms of the elements M is smaller than 1000 and equal to or larger than 50. When the spectrum prediction range and the like in the case where the number of atoms is 100 or 500, the number of atoms of the element M can be identified more minutely. The determination of the number of atoms is only a prediction and cannot necessarily ensure identifying the number of atoms of the element M. Nevertheless, the spectrum prediction ranges SPr1 and SPr2 are the spectrum ranges generated based on the natural isotope ratios SPn1 and SPn2, respectively. Accordingly, in the first embodiment, it is possible to determine the number of atoms of the element M with a higher probability than that of the simple comparison of the actual measured spectrums SPp1 and SPp2 with the natural isotope ratios SPn1 and SPn2, respectively.

In the first embodiment, when the number of atoms of the element M contained in the sample 104 is large, the actual measured spectrum is closer to the natural isotope ratio. Accordingly, it is possible to determine whether the element M is present without difficulties. On the other hand, when the number of atoms of the element M contained in the sample 104 is small, it is highly likely that the actual measured spectrums deviate from the natural isotope ratio. Accordingly, the spectrum prediction range is quite effective for determining whether the element M is present and determining the number of atoms of the element M.

A user can determine whether the element M is present and the number of atoms of the element M. In this case, it suffices that the atom probe 100 displays the graphs as shown in FIGS. 9A and 9B on the display 150.

Alternatively, the atom probe 100 can determine whether the element M is present and the number of atoms of the element M. In this case, the atom probe 100 not only displays the graphs as shown in FIGS. 9A and 9B on the display 150 but also causes the arithmetic control unit 130 to compare the actual measured spectrum with the spectrum prediction range and to determine whether the actual measured spectrum falls within the spectrum prediction range.

When the actual measured spectrum falls within the spectrum prediction range, the arithmetic control unit 130 determines that the element M is present in the sample 104 and that the number of atoms of the element M is equal to or larger than the number corresponding to the spectrum prediction range.

When the actual measured spectrum does not fall within the spectrum prediction range, the arithmetic control unit 130 determines that the number of atoms of the element M is smaller than the number corresponding to the spectrum prediction range or that the element M is not present in the sample 104. For example, when the other spectrum prediction range relating to the element M is prepared, the arithmetic control unit 130 performs Step S70 again using the other spectrum prediction range. Specifically, the arithmetic control unit 130 performs Step S70 again using the spectrum prediction range in the case where the number of atoms of the element M is smaller. When the actual measured spectrum does not fall within the spectrum prediction range even by using the spectrum prediction range in a case where the number of atoms of the element M is the smallest, the arithmetic control unit 130 determines that the element M is not present in the sample 104.

In this way, the atom probe 100 can automatically determine the presence of the element M or the number of atoms of the element M. The determination result of the atom probe 100 is displayed on the display 150. The material inspection method and determination method described above can be stored in the memory 140 of the atom probe 100 as programs.

Detection accuracy for detecting whether the element M is present and positions of the atoms of the element M can be improved using not only the atom probe 100 but also a TEM (Transmission Electron Microscope), an STEM (Scanning Transmission Electron Microscope), an SEM (Scanning Electron Microscope), or the like. For example, it is possible to identify positions of materials using the TEM, and to correct the positions of the materials in the detection result of the atom probe 100 using a result of the TEM.

Moreover, measurement conditions of the atom probe 100 can be determined using the spectrum prediction range.

First Modification

When key materials differ in a depth direction of the sample 104, the atom probe 100 can generate or store the spectrum prediction range of the element of interest M for each of the key materials. When key materials differ among regions of the sample 104, the mass of the element M has different dispersions depending on the regions of the sample 104. Therefore, different spectrum prediction ranges of the element M can be prepared for the respective regions of the sample 104. With this configuration, it is possible to generate the spectrum prediction ranges in light of the influence of background materials on the sample 104. In this case, the atom probe 100 can determine the presence of the element M and the number of atoms of the elements M using the spectrum prediction ranges corresponding to the respective materials.

Second Modification

The size, the shape, and the concentration of the sample 104 that make it possible to ensure detecting the element M can be estimated or ionization conditions and detection efficiency that make it possible to ensure detecting the element M can be estimated and adjusted based on an estimated number of atoms of the element M in the first embodiment. By producing the sample 104 having such a size and shape and allowing the atom probe 100 to perform the material detection again, it is possible to further ensure estimating the presence of the element M and the number of atoms of the element M. It is thereby possible to reduce background spectrums (noise) and to further ensure detecting the element M even with fewer atoms.

In the first and second modifications, not only an observation result of the atom probe 100 but also that of the TEM, the STEM, the SEM, or the like can be used. This can further ensure determining a suited size and suited shape of the sample 104 for the detection of the element M.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A material inspection apparatus comprising:

a sample mount capable of mounting a sample;

a detector configured to detect an atom desorbed from the sample;

a voltage generator configured to apply a voltage to the sample;

a laser generator configured to irradiate a laser beam onto the sample;

an arithmetic part configured to process a detection result of the detector;

a storage part which stores a spectrum prediction range of a certain element and an isotope of the certain element; and a display configured to display the spectrum prediction range and an actual detection result of the detector in a comparable manner;

wherein the arithmetic part is configured to generate a plurality of the spectrum prediction ranges to correspond to different numbers of atoms of the element and the isotope of the element; and wherein the arithmetic part is configured to determine that the number of atoms of the element and the isotope of the element contained in the sample is equal to or larger than the number of atoms corresponding to one of the spectrum prediction ranges when the actual detection result falls within the one of the spectrum prediction ranges, and determines that the number of atoms of the element and the isotope of the element contained in the sample is smaller than the number of atoms corresponding to the one of the spectrum prediction ranges when the actual detection result does not fall within the one of the spectrum prediction ranges.

2. The apparatus of claim 1, wherein the arithmetic part is configured to generate a plurality of the spectrum prediction ranges to correspond to a plurality of types of elements.

3. The apparatus of claim 1, wherein the arithmetic part is configured to generate the spectrum prediction range using a distribution function resulting from dispersions of masses of the element and the isotope of the element, respectively.

4. The apparatus of claim 1, wherein the arithmetic part is configured to determine that the element is present in the sample when the actual detection result falls within the spectrum prediction range, and to determine that the element is not present in the sample when the actual detection result does not fall within the spectrum prediction range.

* * * * *